US006883725B2

(12) United States Patent
Hohl et al.

(10) Patent No.: US 6,883,725 B2
(45) Date of Patent: Apr. 26, 2005

(54) FUEL INJECTION VALVE

(75) Inventors: Günther Hohl, Stuttgart (DE); Michael Hübel, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/363,961

(22) PCT Filed: May 7, 2002

(86) PCT No.: PCT/DE02/01640

§ 371 (c)(1),
(2), (4) Date: Jun. 26, 2003

(87) PCT Pub. No.: WO03/006820

PCT Pub. Date: Jan. 23, 2003

(65) Prior Publication Data

US 2004/0011892 A1 Jan. 22, 2004

(30) Foreign Application Priority Data

Jul. 9, 2001 (DE) ..... 101 33 265

(51) Int. Cl.[7] ..... B05B 1/08
(52) U.S. Cl. ..... 239/102.2; 239/584
(58) Field of Search ..... 239/584, 102.1, 239/102.2

(56) References Cited

U.S. PATENT DOCUMENTS 6,142,443 A 11/2000 Potschin et al.
6,299,074 B1 * 10/2001 Cooke ..... 239/102.2
6,302,333 B1 * 10/2001 Hoffmann et al. ..... 239/88
6,685,105 B1 * 2/2004 Ruehle et al. ..... 239/102.1

FOREIGN PATENT DOCUMENTS

| | | |
|---|---|---|
| DE | 195 19 191 | 12/1996 |
| DE | 199 46 732 | 4/2001 |
| DE | 199 54 802 | 5/2001 |
| DE | 199 58 704 | 6/2001 |
| EP | 0 477 400 | 4/1992 |
| EP | 0 907 017 | 7/1999 |
| EP | 1 209 351 | 5/2002 |

* cited by examiner

*Primary Examiner*—Christopher Kim
(74) *Attorney, Agent, or Firm*—Kenyon & Kenyon

(57) ABSTRACT

A fuel injector, in particular a fuel injector for fuel-injection systems of internal combustion engines, has a piezoelectric or magnetostrictive actuator which actuates, via a hydraulic coupler a valve-closure member formed on a valve needle, the valve-closure member cooperating with a valve-seat surface to form a sealing seat. The coupler is made up of a pressure cylinder, a pressure-cylinder support joined to the pressure cylinder, and a pressure piston guided in this pressure cylinder, which form a pressure chamber; and of a coupler spring element between the pressure piston and the pressure cylinder which generates a prestressing force that forces the pressure piston out of the pressure cylinder.

11 Claims, 1 Drawing Sheet

FUEL INJECTION VALVE

FIELD OF THE INVENTION

The present invention is directed to a fuel injector of the type having a piezoelectric or magnetostrictive actuator.

BACKGROUND INFORMATION

EP 0 477 400 discloses a system for an adaptive, mechanical tolerance compensation, effective in the lift direction, for a path transformer of a piezoelectric actuator for a fuel injector. The actuator lift is transmitted via a hydraulic chamber in this case. The hydraulic chamber has a defined leakage with a defined leakage rate. The lift of the actuator is initiated into the hydraulic chamber via a transmitter master piston and transmitted to an element to be operated via a receiver slave piston. This element, for example, is a valve needle of a fuel injector.

EP 0 477 400 discloses a path transformer for a piezoelectric actuator in which the actuator transmits a lifting force to a transmitter cylinder which is sealed by a cylinder support. Guided in this transmitter cylinder is a receiver piston which likewise seals the transmitter cylinder and thereby forms the hydraulic chamber. A spring which pushes the transmitter cylinder and the receiver piston apart is positioned in the hydraulic chamber. The receiver piston mechanically transmits a lifting movement to a valve needle, for instance. When the actuator transmits a lifting movement to the transmitter cylinder, this lifting movement is transmitted to the receiver piston by the pressure of an hydraulic fluid in the hydraulic chamber since the hydraulic fluid in the hydraulic chamber is not compressible and only a very small portion of the hydraulic fluid is able to escape through the annular gap during the short duration of a lift. In the rest phase, when the actuator does not exert a pressure force on the transmitter cylinder, the spring presses the receiver piston out of the cylinder and, due to the generated vacuum pressure, the hydraulic fluid enters the hydraulic chamber via the annular gap and refills it. In this way, the path transformer automatically adapts to longitudinal deformations and pressure-related extensions of a fuel injector.

This known art is disadvantageous in that the hydraulic chamber can only be filled slowly. Long injection times occur especially in a cold start at low pressure, so that more hydraulic fluid escapes via the annular gap and must subsequently be refilled in a shorter period of time at low pressure. If this is not done, the fuel injector loses lift in each injection until it is entirely unable to function.

It is also disadvantageous that the hydraulic fluid can evaporate if insufficient pressure prevails in the hydraulic chamber. However, gas is compressible and generates an appropriately high pressure only after a considerable reduction in volume.

This poses a particular danger when shutting off a hot internal combustion engine which uses a fuel injector for gasoline and in which the gasoline is simultaneously used as the hydraulic fluid. A fuel injection system then loses its pressure, and the gasoline evaporates particularly easily. In a new effort to start the internal combustion engine, this may result in the lifting movement of the actuator not being transmitted to the needle since the following flow of cool fuel does not reach the hydraulic chamber soon enough.

SUMMARY OF THE INVENTION

The fuel injector according to an embodiment of the present invention has a coupler valve-seat member that lifts off from the coupler valve seat once the coupler fails to assume the potential length as the transmission element between the actuator and the valve needle, in this way releasing a potential inflow for the fuel to the pressure chamber via the inflow bore. Since the cross-sectional area taken up by the coupler valve-sealing seat is smaller than the cross-sectional area of the pressure piston, both the coupler spring element and also the increased pressure in the coupler chamber during the activation exert a closing effect on the coupler valve-sealing seat. Due to the relatively large cross section of the inflow bore, fuel may now quickly flow into the pressure chamber until the coupler spring element, at pressure parity in the pressure chamber and the fuel inflow, has forced the pressure piston out from the pressure cylinder to such an extent that the coupler valve-closure member sets down on the coupler valve-seat surface. In this way, the coupler valve-sealing seat interrupts the inflow of fuel from the fuel inflow into the pressure chamber. This is particularly advantageous in those cases where, following a standstill of an internal combustion engine after considerable loading and, thus, high temperature of the fuel injector, gas has formed in the pressure chamber. Since no, or only low, pressure prevails in the fuel inflow in the shut-off state of the internal combustion engine, the fuel, due to the gas of the evaporating fuel, is forced into the fuel inflow through the annular gap between the pressure piston and the pressure cylinder. When the internal combustion engine is started, the actuator exerts a lifting force on the coupler. However, since gas is compressible, this lifting movement is not transmitted further to the valve needle. In contrast, in the fuel injector configured according to the present invention it is advantageous that, as soon as the fuel pressure rises in the fuel inflow, the coupler valve-closure member is lifted off from the coupler valve-seat surface, the coupler valve-sealing seat is released and fuel under overpressure flows into the pressure chamber. This fuel compresses the gas and cools the pressure chamber at the same time, thereby causing the evaporated fuel to condense.

If, for instance, during a cold start, the fuel injector is activated for an extended period of time so that the coupler volume has been reduced by leakage via the annular gap, the coupler valve-sealing seat is released when the actuator is reset. In this way, the coupler chamber is quickly refilled until it has again obtained its original position, and the coupler valve-sealing seat closes.

Furthermore, in the fuel injector according to an embodiment of the present invention, expansions of the fuel injector, due to temperature changes and changes in the fuel pressure, are automatically compensated in the transmission path between the actuator and valve needle. The lift of the valve needle is always able to remain the same.

The coupler valve-closure member may be embodied as a spherical surface and the corresponding coupler valve-seat surface at the valve needle as a conical surface.

In additional embodiments, the inflow bore is formed in the pressure-cylinder support, and the coupler valve-closure member is formed in one piece with the pressure-cylinder support and the pressure cylinder.

A small design is able to be achieved in accordance with the present invention. In addition, by the gradient of the conical surface and the form design of the hemispherical surface, it is possible to constructionally define how large the effective surface is that is sealed from the fuel inflow by the cross-sectional area of the coupler valve-sealing seat. For the functioning of the fuel injector according to the present invention, this effective area must be smaller than the effective surface of the pressure piston.

In an additional embodiment, the coupler valve-seat surface is formed at the valve needle and the pressure piston is joined to a guide piston guided in a bore in a partition shield that shields the fuel inflow from an actuator chamber. Moreover, a corrugated tube is provided at the guide piston to seal this actuator chamber. This embodiment combines components and saves unit volume of the fuel injector.

In an another embodiment, the lift of the valve needle may be restricted by a stop of an actuator head or, alternatively, by a stop of the valve needle or, as an alternative, by a stop of the pressure piston or the pressure cylinder.

When the lift restricted by the stop is always less than the minimum lift of the actuator in all operating states, an always identical and defined lift of the valve needle is able to be achieved, regardless of the expansion and elongation of a valve member of the fuel injector.

DETAILED DESCRIPTION

Figure 1:
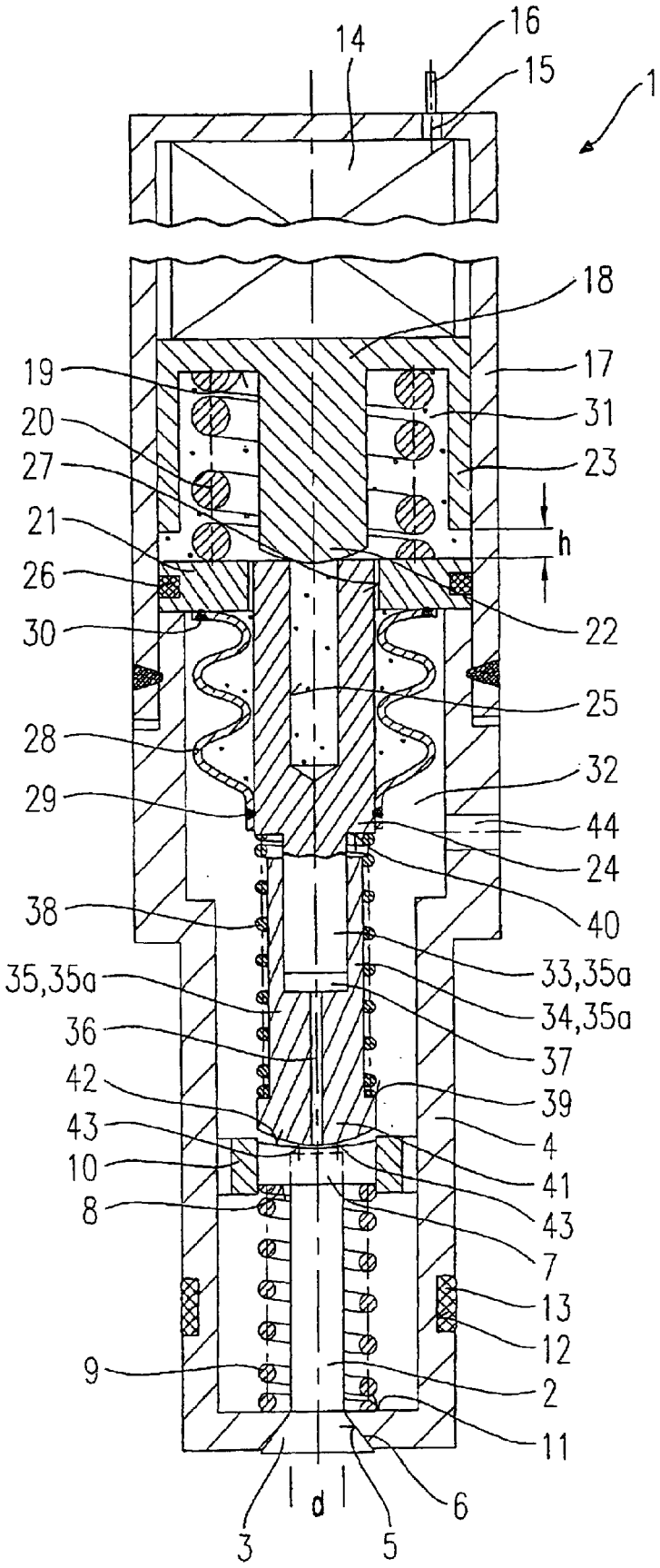
FIG. 1 depicts a schematic section through an exemplary embodiment of a fuel injector configured according to the present invention.

Fuel injector 1, schematically shown in FIG. 1, has a valve needle 2 which is joined to a valve-closure member 3 and cooperates via this valve-closure member 3 with a valve-seat surface 5 formed in a valve member 4 to form a valve-sealing seat. Fuel injector 1 is on outwardly opening fuel injector provided with a valve needle 2 that opens toward the outside. Valve needle 2 is guided in a valve-needle guide 10 by a guide section 7 which includes a spring setup 8 for a valve-closure spring 9. Valve-closure spring 9 is braced against a second spring system 11 at valve member 4 and provides valve needle 2 with an initial stress which presses valve-closure member 3 against valve-seat surface 5. A sealing ring 13 positioned in a groove 12 provides a sealing of the ring gap (not shown here) between valve member 4 and a bore (likewise not shown) in a cylinder head of an internal combustion engine.

To actuate valve needle 2, a piezoelectric or magnetostrictive actuator 14 is positioned in a valve-member upper section 17, which is able to be provided with a voltage via a bore 15 in valve-member upper section 17 and an electrical supply line 16. Actuator 14 has a larger overall length so as to obtain a perceptible lift when a voltage is applied to actuator 14. The largest part of the overall length of actuator 14 is not represented in FIG. 1. Adjoining actuator 14 is an actuator head 18 provided with a spring contact surface 19 at which an actuator tension spring 20 rests, which in turn is braced against a partition shield 21. Actuator spring 20 provides an initial stress to actuator 14, so that, in response to voltage being applied to electrical supply line 16, the lift of actuator 14 is transmitted to actuator head 18. Formed on actuator head 18 is a pressure tappet 22, which is integrally formed with actuator head 18 and transmits the lift of actuator 14. Actuator head 18 is guided in valve-member upper section 17 by an actuator-head sleeve 23 and, following a maximum valve travel h, this actuator-head sleeve 23 strikes against partition shield 21, thereby limiting maximum valve travel h of actuator 14.

Actuator-head tappet 22 transmits the lifting movement of actuator 14 to a pressure-piston support 24 into which a blind-hole bore 25 has been centrally introduced. Pressure-piston support 24 is guided by a guide bore 27 which penetrates support plate 21. Support plate 21 is sealed from valve-member upper section 17 by a sealing ring 26. A corrugated tube 28 concentrically encloses pressure-piston support 24 and is affixed to pressure-piston support 24 by a welded seam 29. On the other side, corrugated tube 28 is attached to support plate 21 by a welded seam 30. In response to a lifting of actuator 14 and an attendant movement of actuator head 18 having actuator-head tappet 22 formed thereon, pressure-cylinder support 24 is moved in the longitudinal direction, corrugated tube 28 following this movement and expanding correspondingly. At the same time, corrugated tube 28 which, by welded seams 30 and 29, has sealed ends with respect to pressure-cylinder support 24 and support plate 21, seals an actuator chamber 31 from a fuel chamber 32.

Formed in one piece with pressure-piston support 24 is a pressure piston 33 functioning as the transmitter piston, which is guided inside a pressure cylinder 34 functioning as the receiver cylinder. Pressure cylinder 34 is integrally formed with a pressure-cylinder support 35. Centrally guided through pressure-cylinder support 35 is an inflow bore 36. Inside pressure cylinder 34, which is sealed by pressure piston 33, is a pressure chamber 37. Pressure piston 33, pressure cylinder 34 and pressure-cylinder support 35 form hydraulic coupler 35*a*. Concentrically around pressure piston 33 and pressure cylinder 34, hydraulic coupler 35*a* is provided with a coupler helical spring 38 between a spring stop 39 at pressure-cylinder support 35 and an additional spring stop 40 at pressure-piston support 24. Inflow bore 36 is separated from fuel chamber 32 by a coupler valve-closure member, which is embodied as a hemispherical surface on pressure-cylinder support 35, and by a coupler valve-seat surface 42, which is embodied as a conical surface on guide section 7 of valve needle 2, forming a coupler valve-sealing seat. A discoid surface having diameter d results from the coupler valve-sealing seat, this surface not being acted upon by the pressure of the fuel held in fuel chamber 32. The fuel flows into fuel chamber 32 via a fuel-inflow bore 44.

In response to voltage being applied to actuator 14 via the electrical supply, actuator 14 expands in the longitudinal direction of fuel injector 1 and presses actuator head 18 with actuator tappet 22 formed thereon in the direction of valve seat 6. The lift is restricted to a lift h by the stop of actuator-head sleeve 23 at partition shield 21. The movement is transmitted to pressure-piston support 24 and pressure piston 33. The fuel contained in pressure chamber 37, being a fluid, is unable to be compressed and, thus, transmits the movement to pressure-cylinder support 35. Due to the spring force of coupler helical spring 38 and the force of actuator 14, coupler valve-closure member 41 is pressed onto coupler valve-seat surface 42. This causes coupler valve-sealing seat 43 to close sealingly, and no fuel is able to escape from pressure chamber 37. Valve needle 2 opens to the outside, lifting off from valve-sealing seat 6. During the lift, only a gap-loss fuel quantity may escape from pressure chamber 37 through the annular gap between pressure piston 33 and pressure cylinder 34. At the conclusion of the lift, the actuator is pressed back by actuator spring 23, and valve-needle spring 9 presses valve needle 2 into its valve-sealing seat 6. Corrugated tube 28, which has-been provided with an initial stress, keeps pressure-piston support 24 sealingly against actuator-head tappet 22. Since a small quantity of fuel from pressure chamber 37 has reached fuel chamber 32 via the annular gap and since the fuel in fuel chamber 32 is under superpressure, coupler valve-sealing seat surface 43 opens now because the diameter of the cross-sectional surface sealed by coupler valve-sealing seat surface 43 from the fuel pressure in fuel chamber 32 is smaller than the diameter of pressure piston 33, and the spring force of coupler helical spring 38 is overcome. Pressurized fuel is now able to flow from fuel chamber 32 past coupler valve-sealing seat 43 through inflow bore 36 into pressure chamber 37. As soon as the pressure is equalized in pressure chamber 37 and in fuel chamber 32, coupler helical spring 38 pulls pressure piston 33 out of pressure cylinder 34 until coupler valve-closure member 41 comes to rest on coupler valve-seat surface 42 and coupler valve-sealing seat 43 is closed again.

Fuel injector 1 configured according to the present invention and having the described transmission path of the lifting force from actuator 14 to valve needle 2, in this way advantageously adjusts to the expansions of valve member 4 and of valve-member upper section 17 in response to pressure fluctuations in the fuel pressure. Temperature-related expansions are also compensated for.

Furthermore, a malfunction of fuel injector 1, for instance during a renewed start, may be prevented in an advantageous manner after an internal combustion engine has been turned off while still warm from operating. Fuel chamber 32 slowly loses fuel pressure once an internal combustion engine has been turned off while still warm from operation. This may lead to the evaporation of fuel in pressure chamber 37. Without fuel injector 1 configured according to the present invention, the evaporated fuel in pressure chamber 37 would be compressed as gas during a renewed start, without generating the required pressure to open valve needle 2. During a start of the internal combustion engine, an external pump (not shown here) first pressurizes the fuel in combustion chamber 32. Subsequently, as described before, in a fuel injector 1 configured according to the present invention, coupler valve-sealing seat 43 is opened and fuel flows into pressure chamber 37 via inflow bore 36. This causes cooling, and the evaporated fuel condenses.

What is claimed is:

1. A fuel injector for a fuel-injection system of an internal combustion engine, comprising:

a valve-seat surface;

a valve-closure member forming a sealing seat with the valve-seat surface;

a valve needle, wherein the valve-closure member is positioned at the valve needle;

a hydraulic coupler having a pressure cylinder, a pressure-cylinder support joined to the pressure cylinder and including a coupler valve-closure member, and a pressure piston guided in the pressure cylinder, wherein a pressure chamber is formed inside the pressure cylinder;

an actuator for actuating the valve-closure member via the hydraulic coupler, wherein the actuator is one of a piezoelectric and magnetostrictive actuator;

a coupler spring element positioned between the pressure piston and the pressure cylinder, the coupler spring element generating an initial stress that drives the pressure piston out of the pressure cylinder;

a coupler valve-seat surface cooperating with the coupler valve-closure member by the spring force of the coupler valve-spring element to form a coupler valve-sealing seat, a cross-sectional surface of the coupler valve-sealing seat being smaller than a cross-sectional surface of the pressure piston; and a fuel inflow connected to the pressure chamber by an inflow bore in the pressure-cylinder support, and by the coupler valve-sealing seat.

2. The fuel injector as recited in claim 1, wherein the coupler valve-seat surface is formed on the valve needle.

3. The fuel injector as recited in claim 2, wherein the coupler valve-seat surface is a conical surface.

4. The fuel injector as recited in claim 3, wherein the coupler valve-closure member has as a spherical surface.

5. The fuel injector as recited in claim 1, wherein the coupler valve-closure member, the pressure-cylinder support, and the pressure cylinder are integrally formed.

6. The fuel injector as recited in claim 1, wherein the coupler valve-seat surface is formed on the valve needle and the pressure piston is connected to a guide piston guided in a bore of a partition shield.

7. The fuel injector as recited in claim 6, further comprising:

a corrugated tube affixed on the guide piston to seal an actuator chamber.

8. The fuel injector as recited in claim 1, wherein the coupler-spring element is a helical spring concentrically positioned around the pressure piston and the pressure cylinder.

9. The fuel injector as recited in claims 1, further comprising:

an actuator head stop that restricts a maximum lift of the actuator.

10. The fuel injector as recited in claim 1, further comprising:

a valve needle stop that restricts a maximum lift of the valve needle.

11. The fuel injector as recited in claim 1, further comprising:

a stop that restricts a lifting movement of one of the pressure piston and the pressure cylinder.

* * * * *